US005800010A

United States Patent [19]

May

[11] Patent Number: 5,800,010

[45] Date of Patent: Sep. 1, 1998

[54] RECLINING CHAIR AND MECHANISM THEREFOR

[75] Inventor: Teddy J. May, Tupelo, Miss.

[73] Assignee: The Lane Company, Inc., Altavista, Va.

[21] Appl. No.: 827,183

[22] Filed: Mar. 27, 1997

[51] Int. Cl.[6] ..... A47C 1/038

[52] U.S. Cl. ..... 297/85; 297/84

[58] Field of Search ..... 297/68, 69, 84, 297/85, 89

[56] References Cited

U.S. PATENT DOCUMENTS

| | | | |
|---|---|---|---|
| 3,069,201 | 12/1962 | Belisle et al. | 297/85 |
| 3,462,190 | 8/1969 | Campbell | 297/85 |
| 3,550,952 | 12/1970 | Ferguson | 297/85 |
| 3,622,198 | 11/1971 | Re | 297/84 |
| 4,147,336 | 4/1979 | Yamawaki et al. | 267/111 |
| 4,247,146 | 1/1981 | Cycowicz et al. | 297/89 X |
| 4,367,895 | 1/1983 | Pacitti et al. | 297/85 |
| 4,904,019 | 2/1990 | May | 297/85 |
| 4,989,914 | 2/1991 | Pine | 297/85 |
| 5,072,988 | 12/1991 | Plunk | 297/85 X |
| 5,141,284 | 8/1992 | LaPointe | 297/85 |
| 5,156,441 | 10/1992 | Byersmith et al. | 297/423 |
| 5,217,276 | 6/1993 | LaPointe et al. | 297/85 |
| 5,346,285 | 9/1994 | West, III | 497/452.18 |
| 5,427,431 | 6/1995 | Saul et al. | 297/85 |
| 5,527,092 | 6/1996 | Cook et al. | 297/232 |

*Primary Examiner*—Peter R. Brown

*Attorney, Agent, or Firm*—IP Group of Pillsbury Madison & Sutro LLP

[57] ABSTRACT

A mechanism for a reclining chair is caused to be more appropriate for use by a person who is significantly taller and heavier than average, not only by being made larger and of thicker or stronger parts, but also by having supports extending obliquely forwardly and downwardly from pivotal connections to the operating handle torque tube, at the left and right sides, to pivotal connections at the left and right front corners of the fixed base. By preference, the mechanism has a rectangular support for the seat portion of the seat and arm frame unit, and links particularly subject to buckling are embossed with ribs for reinforcement.

8 Claims, 9 Drawing Sheets

RECLINING CHAIR AND MECHANISM THEREFOR

BACKGROUND OF THE INVENTION

The present invention relates to a reclining chair and a mechanism therefor, and especially to a reclining chair and mechanism which is particularly useful in providing an article of motion seating furniture for use by a person who is significantly taller and heavier than the average adult human (e.g., is more than six feet tall and weights more than 300 pounds).

Heretofore, such persons have been underserved by the available selection of seating furniture, and particular motion seating furniture (e.g., free-standing reclining chairs, and reclining chairs incorporated into sectional sofas and the like).

Were such people merely larger in height and width, it would be a fairly simple matter to scale-up existing designs of furniture to have a taller seating surface, a broader seating area, a deeper seating area (in the front to rear direction), a taller back or headrest, and a longer thrust of the side linkages for projecting the legrest(s) (also known as the ottoman(s) or footrest(s)).

However, many people who are significantly taller than average, are also significantly heavier than average. Therefore, the present inventor has discovered that, beyond a scale-up in size, some heretofore not considered changes in design are needed for importing adequate robustness to the mechanism for a reclining chair to make it confidently salable to and useable by such individuals among the populace.

SUMMARY OF THE INVENTION

A mechanism for a reclining chair is caused to be more appropriate for use by a person who is significantly taller and heavier than average, not only by being made larger and of thicker or stronger parts, but also by having supports extending obliquely forwardly and downwardly from pivotal connections to the operating handle torque tube, at the left and right sides, to pivotal connections at the left and right front corners of the fixed base. By preference, the mechanism has a rectangular support for the seat portion of the seat and arm frame unit, and links particularly subject to buckling are embossed with ribs for reinforcement.

The principles of the invention will be further discussed with reference to the drawings wherein preferred embodiments are shown. The specifics illustrated in the drawings are intended to exemplify, rather than limit, aspects of the invention as defined in the claims

The terms "left" and "right" as used to describe the sides of the mechanism or chair are used from viewpoint of a person occupying the chair. The "handle side" in the preferred embodiment is the right side of the chair. The term "inboard side" of a side linkage refers to the side viewed looking outwards from medially of the chair, and the term "outboard side" of a side linkage refers to the side viewed looking from outside towards the side mechanism.

DETAILED DESCRIPTION

Figure 1:
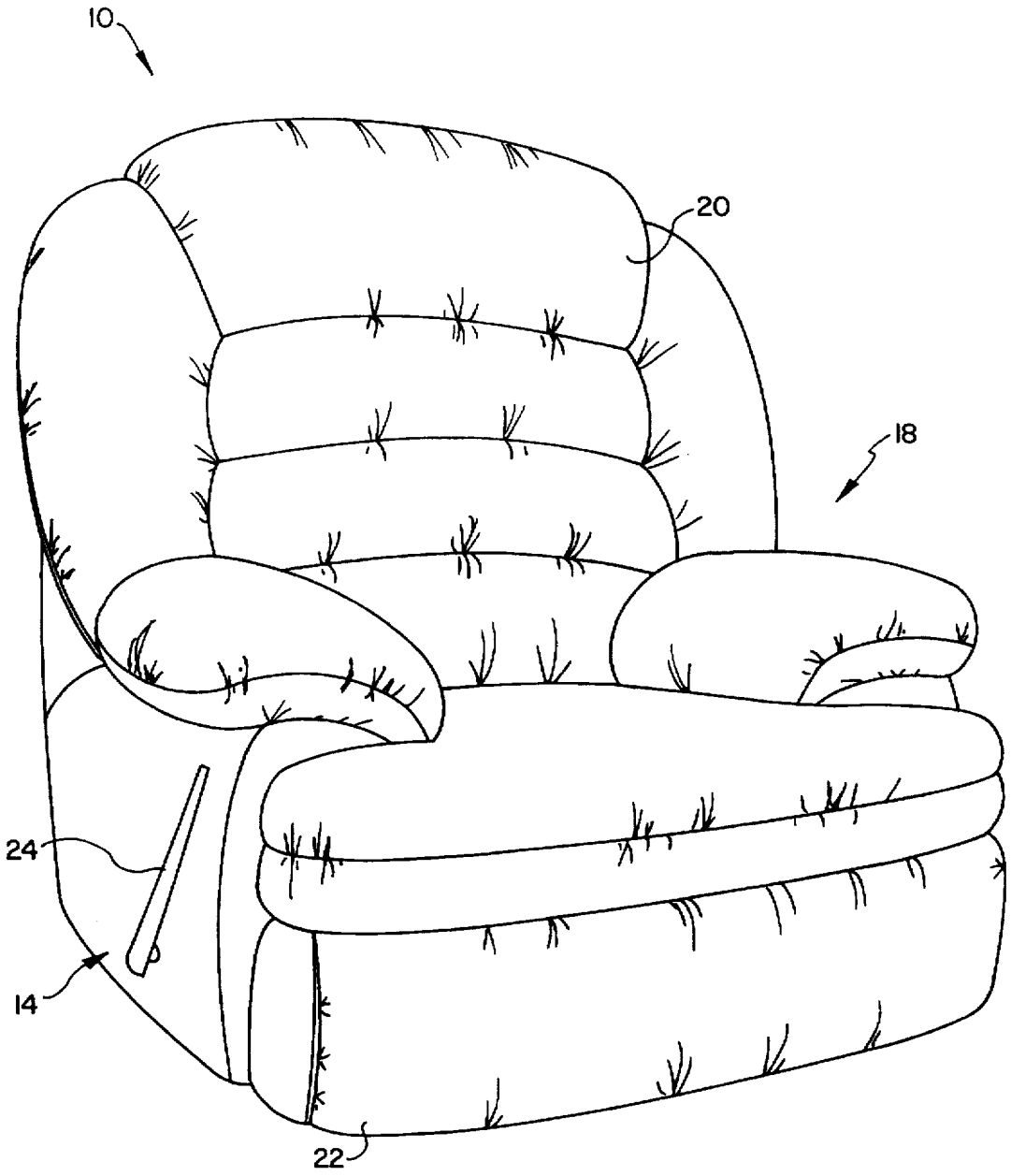
FIG. 1 is a perspective view of a reclining chair embodying principles of the present invention.

The chair 10 (FIG. 1) includes a base 12 (FIG. 2), a motion chair mechanism 14, a mounting bracket 16, an upholstered seat and arm frame unit 18, an upholstered back 20 and an upholstered ottoman 22 (the primary member only of which shows in FIG. 1, the secondary member of which being stored therebehind in this position of the chair. (Ottomans are sometimes also known as legrests or footrests.) In this embodiment, the operating mechanism is handle operated, at least for initiation of movement from the FIG. 2 to the FIG. 3 positions, the user-accessible operating handle being shown at 24 in FIG. 1 mounted on an end of a handle tube (to be described below, sometimes also known as a torque tube).

It is a convenient and conventional technique in the manufacture of reclining chairs, which is useful in manufacturing the chair 10, to provide the left and right sides of the base 12 and operating mechanism 14 (and, in this instance, the bracket 16) as corresponding elements of prefabricated mirror image (left and right) sub-assemblies often known as side linkages, certain corresponding elements of which are integrated by being interconnected by transverse interconnecting elements. Eight of these are shown and will be described below.

In this description, the term longitudinal is used to denote the front-to-rear direction, and the term transverse being used to denote the left-to-right direction).

In a handle-operated motion chair, such as the preferred embodiment of the chair 10, the operating handle 24 is mounted on an extension 26 (through an opening through the upholstery of the seat and arm frame unit 18) of a transversely extending torque tube 28, opposite end portions are journalled in sleeve bearings 29, e.g., made of nylon or other self-lubricated synthetic plastic material, mounted in openings in respective links of the left and right side linkages.

In view of the mirror image nature of the left and right side linkages, only one (the inboard side of the left side linkage) is shown in FIGS. 2–9.

The base of the chair 10 could be more complex than the one shown; e.g., it could include a conventional swivel (suitably enlarged and strengthened). In the preferred embodiment, the base 12 is shown simply comprising left and right longitudinal members 30, each provided as an L-sectioned element having a lower, horizontal flange 32 and an upstanding outboard flange 34, laterally interconnected at the front and rear by transverse members 36, 38 each provided on an L-sectioned element having a lower, horizontal flange 40, and having an upstanding foremost flange 42, in the case front transverse member 36, and having an upstanding rearmost flange 44 in the case of the rear transverse member 38.

For lateral stability, the front and rear members 35, 38 can extend outboard somewhat beyond (e.g., two inches beyond)

the longitudinal members 30. The front and rear, e.g., on these extensions, can be provided with downwardly facing floor glides 46, so that the chair 10 can be pushed along the floor to move it occasionally for cleaning under it, or for repositioning it, without marring the floor.

The members 30 are preferably bolted to the members 36 and 38 where they cross and, thus, are vertically juxtaposed.

The seat and arm frame mounting bracket 16 includes left and right longitudinal members 48, each provided as an L-sectioned element having an upper flange 50 located in a seating plane which is tilted up towards the front and down towards the rear from horizontal and an outboard vertical flange 52.

The longitudinal members 48 of the bracket 16 are laterally interconnected at the front and rear by transverse members 54 and 56, each provided as an L-sectioned element having an upper flange 58 located in the aforementioned seating plane, and having a depending rearmost flange 60. The rear transverse member 56 is shown extending outboards of the longitudinal members 48, e.g., by about 4.5 inches at each rear corner, in order to provide cantilevered sites for mounting correspondingly wide portions of the seat and arm frame unit 18 on the bracket 16. Interconnections at corners of the bracket can be provided by nut-and-bolt assemblies installed through respective seating plane flanges where these cross.

Each side linkage of the mechanism 14 includes a main plate 62 which is longitudinally elongated, disposed in a respective vertical plane, and is generally concave upwards as seen in side elevation. Each main plate 62 is fixed near its front and rear, top ends, on the outboard sides of the vertical flanges 52 of the longitudinal members 48 of the bracket 16. (The plates 62 thus could be made integral with the respective members 48.)

The bearings 29 are provided in openings provided transversely through the main plates 62 intermediate the front and rear ends of the main plates 62, below the flanges 50 of the left and right longitudinal members of the bracket 16.

Each of the main plates 62 is shown having a tab 64 cut and bent so as to extend in a medial direction immediately below the lower edges of the flanges 52, near the front ends of the main plates 62. A transverse member 66, e.g., provided as a square-sectioned steel tube, offset downwards between the two members 48 (so as to avoid interfering with downward travel to the upholstered seat as a user sits down in the chair 10), is bolted at its opposite ends to the respective tabs 64.

As is conventional, the ottoman is mounted on left and right pantograph linkage sets which form respective parts of the left and right side linkages. Each of these is shown including forward, middle and rear first links 68, 70 and 72, and forward, middle and rear second links 74, 76 and 78.

Describing one side, the upper, forward ends of the links 68 and 70 are connected by transverse, horizontal axis pivot joints 80, 82 to the vertical, longitudinal flange 84 of a primary ottoman mounting bracket 86, which also has a medially directed flange 88, to which a respective lateral end of the primary ottoman 22 is bolted.

A medially directed flange 90 is bent from the upper end of the link 74, to which a respective end of a secondary ottoman (not shown) is bolted.

The link 74 is connected by upper, middle and lower transverse, horizontal axis pivot joints 94, 96 and 98, respectively to the upper end of link 72, and intermediate site on link 70 and the lower end of link 68.

The link 76 is connected by upper, middle and lower transverse, horizontal axis pivot joints 100, 102 and 104, respectively to the main plate 62 above and forwardly of the transverse member 66, an intermediate site on link 72 and the lower end of link 70.

The link 78 is connected by upper and lower transverse, horizontal axis pivot joints 106, 108, respectively to the main plate 62 below and rearwardly of the transverse member 66, and the lower end of link 72.

Outboard of the main plates 62, the left and right side linkages have respective crank links 110 bolted onto the torque tube 28 so as to each project radially from the torque tube in a respective vertical plane. Near its radially outer end, each crank link 110 is connected by a transverse, horizontal axis pivot joint 112 to the rear, lower end of a respective upwardly concave (in side elevation) driving link 114, the forward end of which is connected by a transverse, horizontal axis pivot joint 116 to an intermediate site on the respective pantograph link 78.

Figure 2:
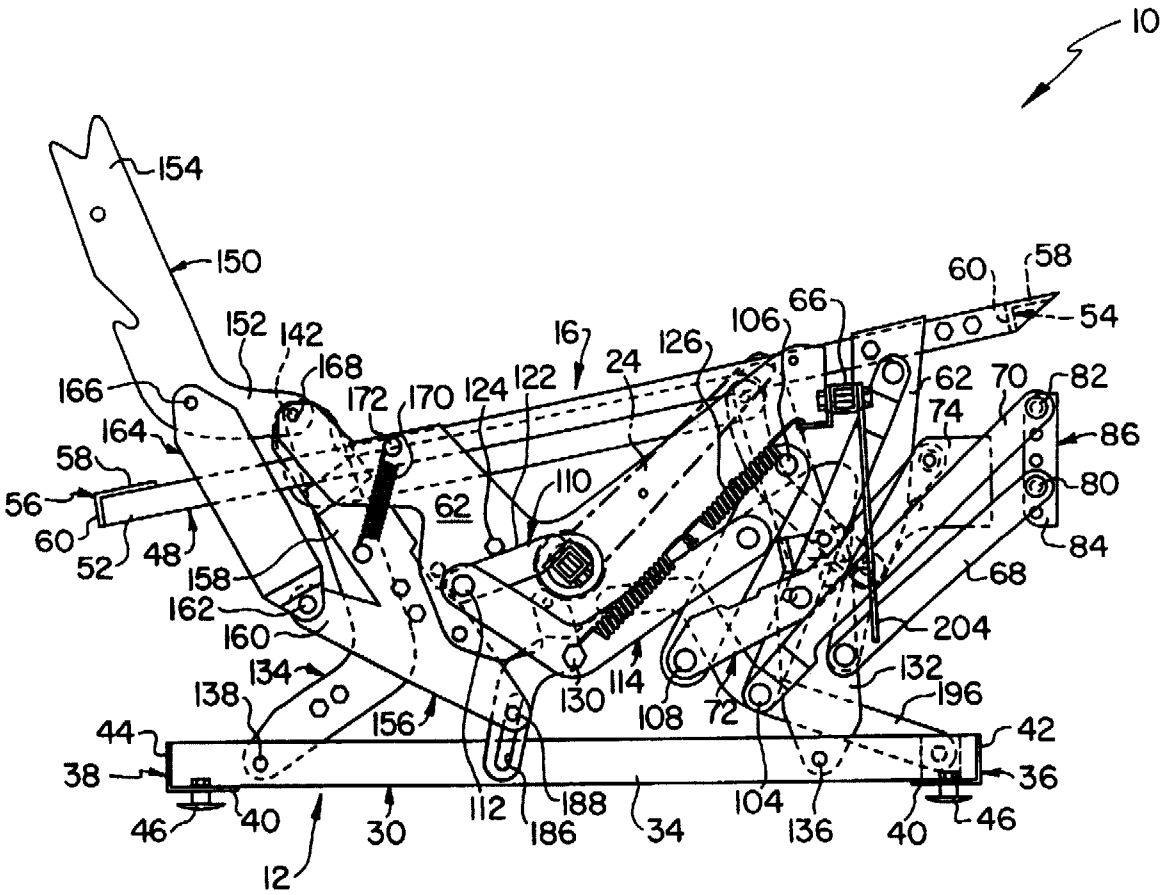
FIG. 2 is a side elevational view of the mechanism for the chair of FIG. 1 (inboard side of left side linkage), shown in the fully erect position thereof.
Figure 3:
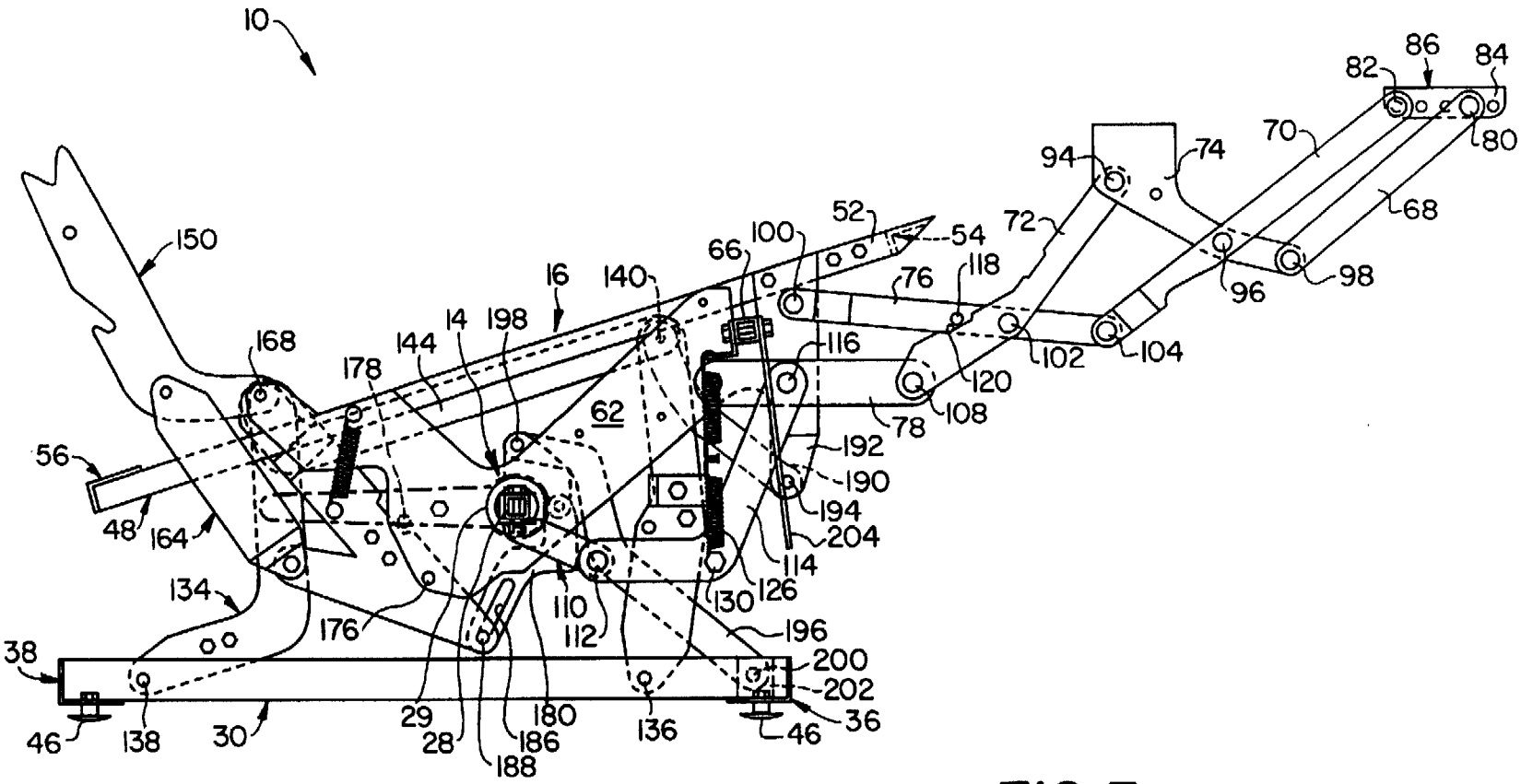
FIG. 3, is a comparable side elevational view of the mechanism, shown in the intermediate, TV position thereof.

Accordingly, rotating the operating handle 24 over top dead center to the rear causes the pantographic linkages to extend the ottoman and secondary ottoman from the stowed position shown in FIGS. 1 and 2, to the raised and extended position shown in FIG. 3.

The curve (in side elevational shape) in the driving links 114 allows the latter to wrap under the stub ends of the torque tube 28 as the handle is rotated forwardly to retract and stow the ottoman and secondary ottoman (from the FIG. 3 position to the FIGS. 1 and 2 position).

Reverting to single-side description, engagement of a laterally outwardly projecting pin 118, provided on the outside of the link 76 at an intermediate location, with the upper, rear side edge at a lower-intermediate site 120 on the link 72 stops extension of the pantographic linkage sets.

Conversely, engagement of an upper edge of a site 122 on the crank link 110 with a laterally outwardly directed pin 124 mounted on the outboard side of the main plate 62 stops retraction of the pantographic linkage sets.

A tension coil spring 126, stretched between and hooked at opposite ends to an eye 128 provided on the transverse member 66, outboard of the main plate 62, and a laterally outwardly directed pin 130 fixed on the driving link 114 at the intermediate, lower elbow of the latter, becomes less stretched with extension of the pantographic linkage set, and more stretched with retraction of the pantographic linkage set, for preventing forward drooping of the ottoman when the chair is in its FIGS. 1 and 2, fully erect position.

Each side linkage further includes a forward upstanding support link 132 and a rear upstanding support link 134 having respective lower ends connected by transverse, horizontal axis pivot joints 136 and 138 to forward and rear sites on the vertical flange 34 of the longitudinal member 30 of the base 12.

The upper ends of the support links 132 and 134 are connected by respective transverse, horizontal axis pivot joints 140, 142 to respectively to the forward and rear ends of a longitudinal link 144 (which in the FIGS. 2 and 3 positions of the mechanism is nestled under the flanges 50 of the longitudinal members 48 of the seat and arm frame mounting bracket 16).

The link 144 is mainly straight, but curves upwards (in side elevation) near its rear end, so that its rear end extends up through a notch cut out of the flange 50 near the rear extent of the longitudinal member 48.

The seventh and eighth transversely extending side linkage interconnecting members 145 and 148 are respectively bolted at opposite ends to intermediate sites on the forward and rear support links 132 and 134.

Figure 4:
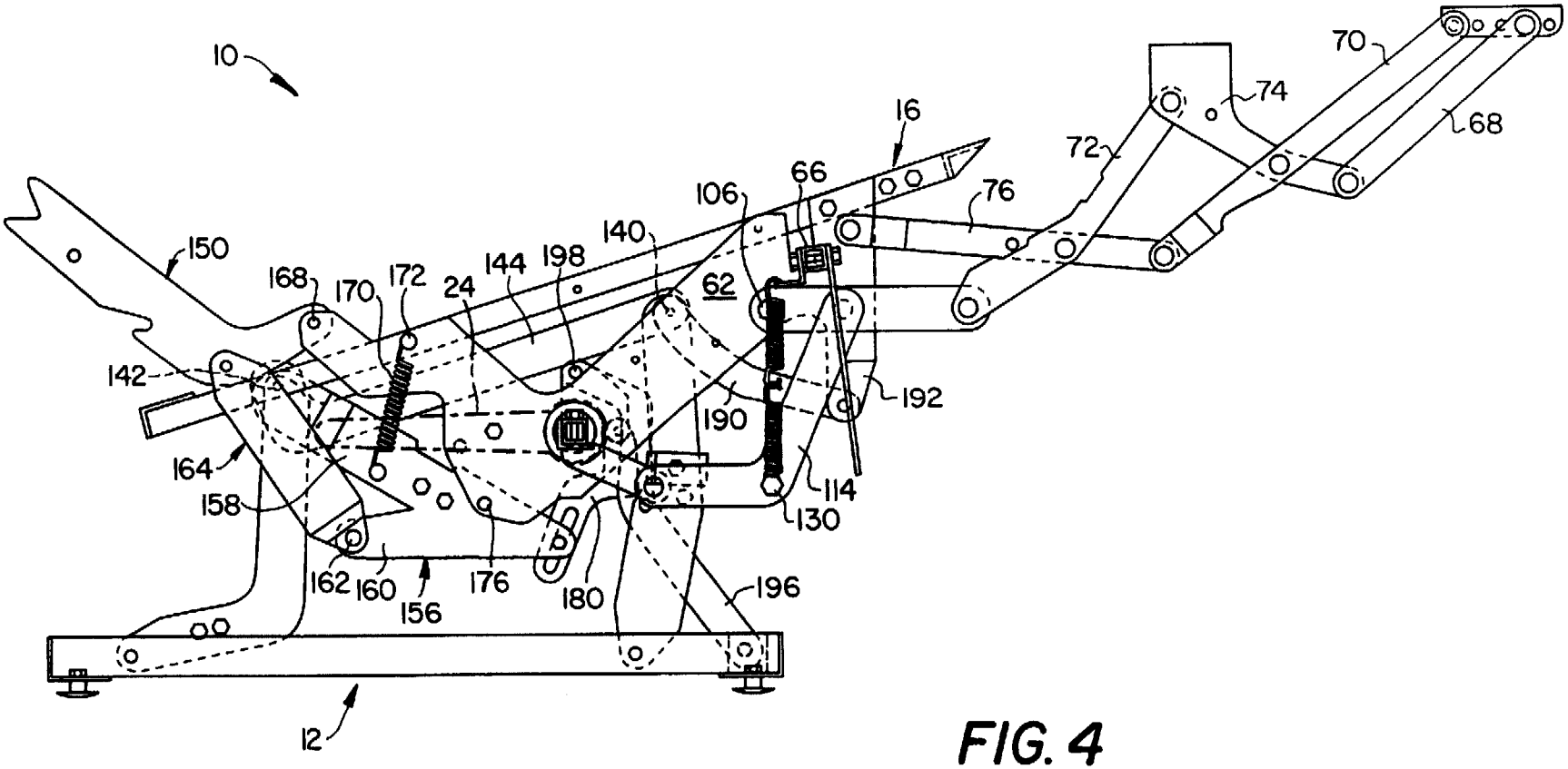
FIG. 4 is a comparable side elevational view of the mechanism, shown in the fully reclined position thereof.
Figure 5:
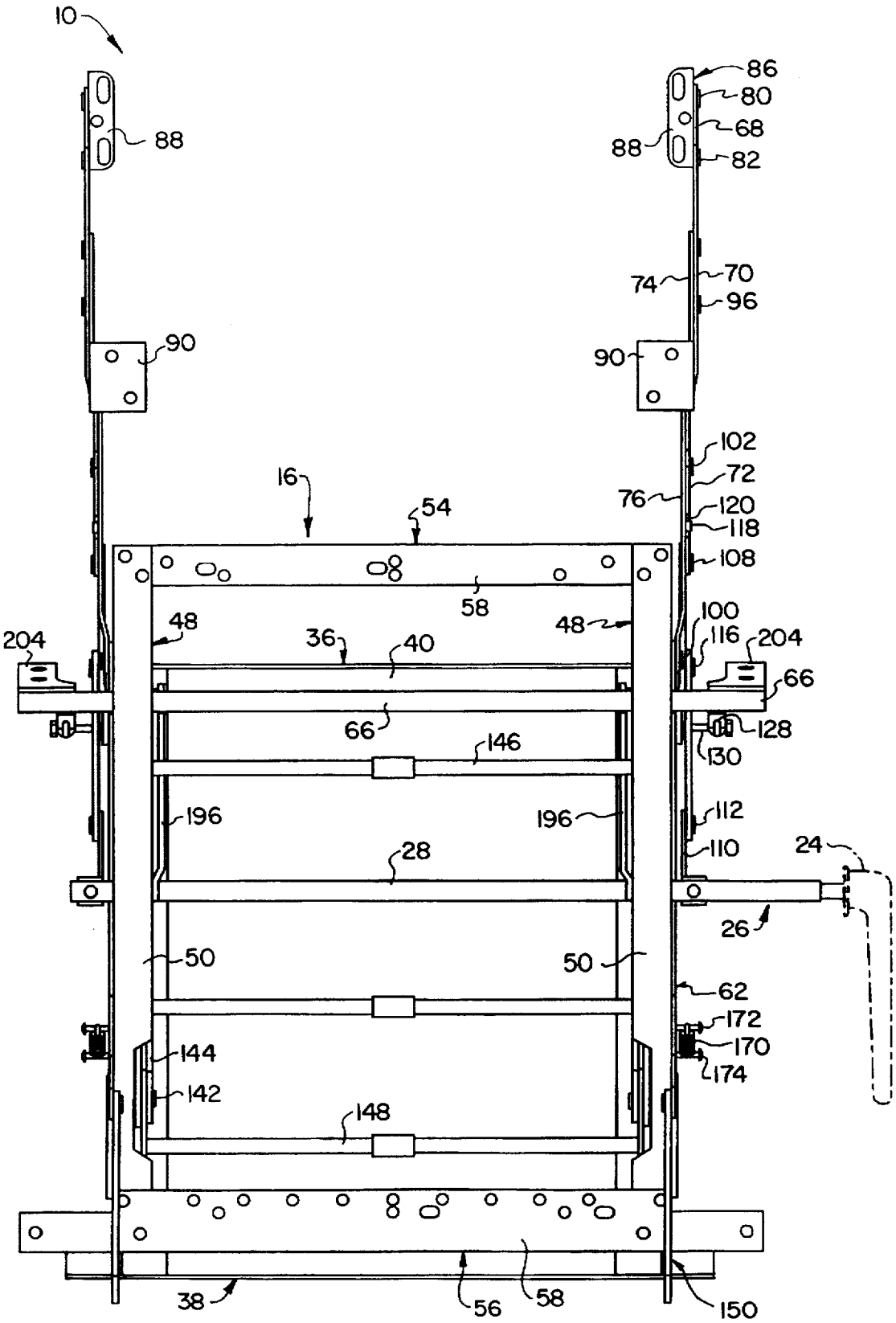
FIG. 5, is a top plan view of the mechanism, shown in the intermediate, TV position thereof.
Figure 6:
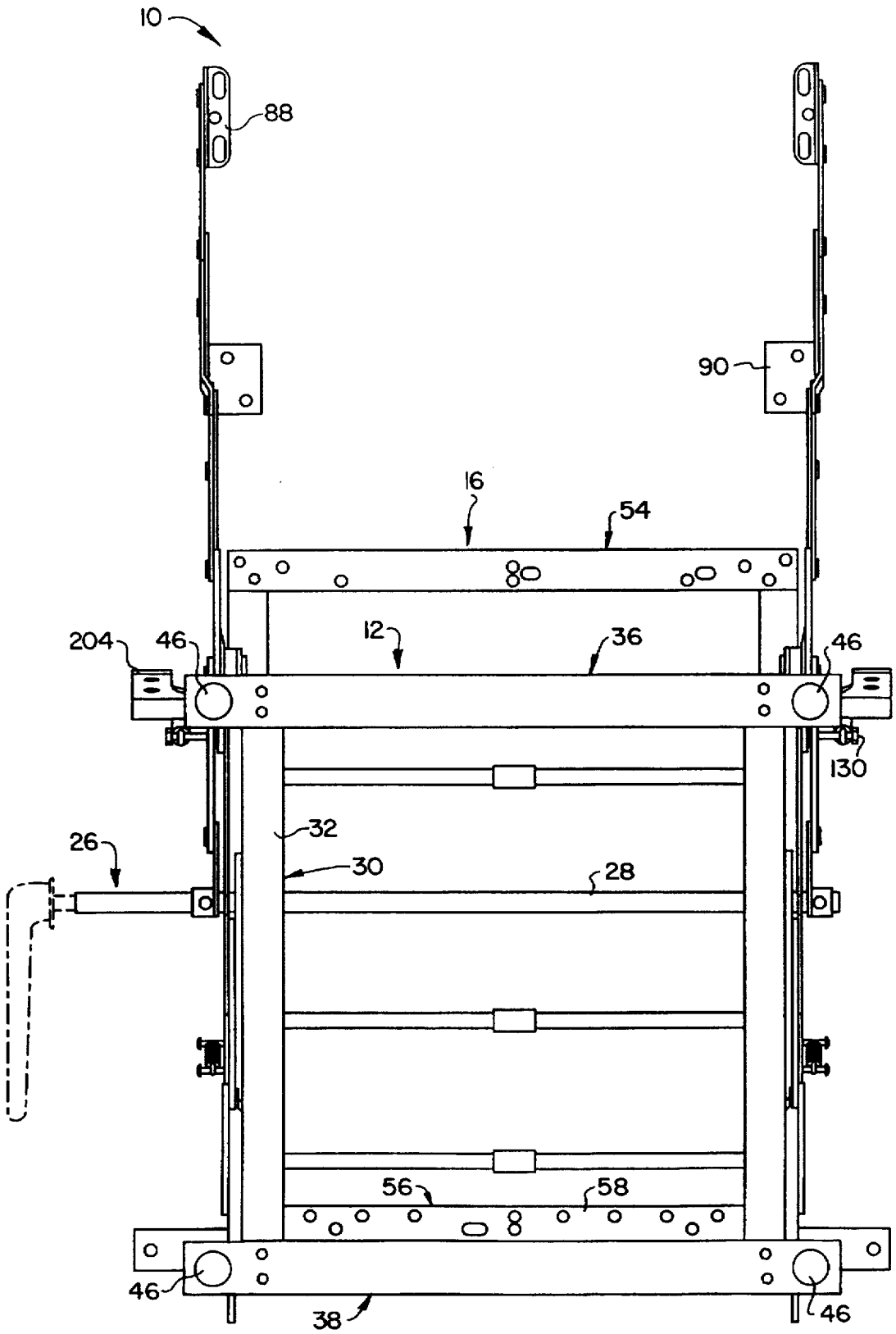
FIG. 6 is a bottom plan view of the mechanism, shown in the intermediate, TV position thereof.
Figure 7:
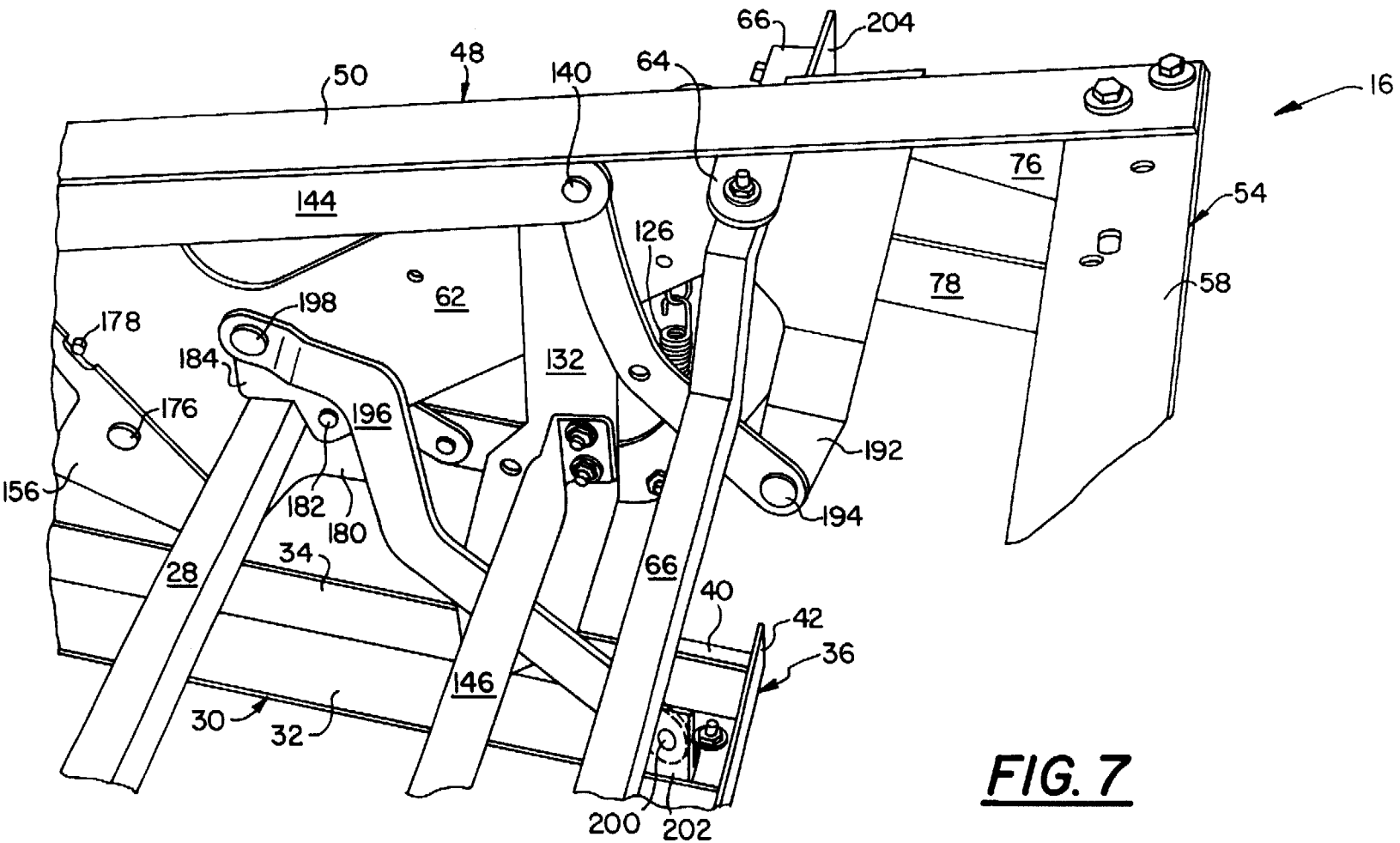
FIG. 7 is a fragmentary left, front inboard perspective view of the mechanism.
Figure 8:
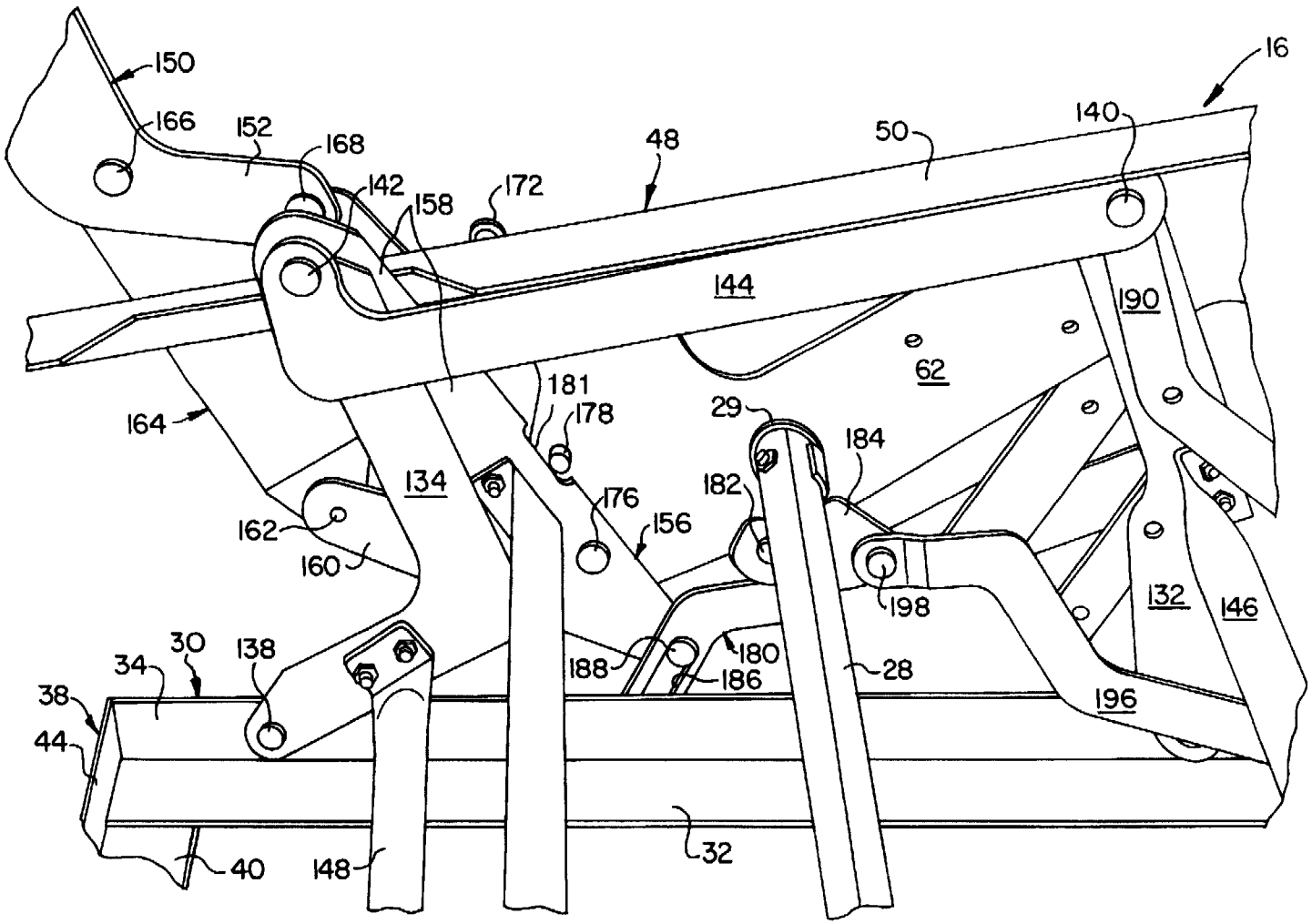
FIG. 8 is a fragmentary left rear inboard perspective view of the mechanism.
Figure 9:
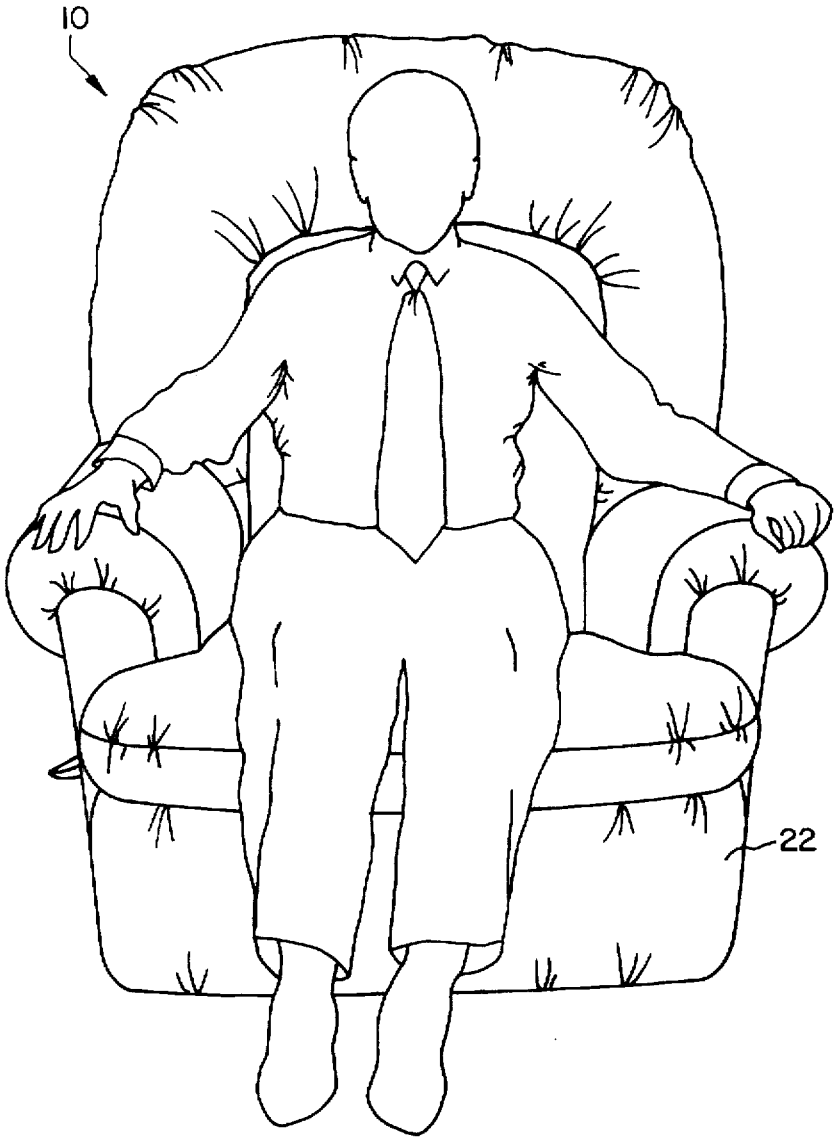
FIG. 9 is a frontal perspective view of the chair schematically showing a person of average stature seated therein.

The side linkages further include interpivoted links for causing the seat and arm frame unit and the pantograph linkage-supported ottoman and secondary ottoman to move forwardly and upwardly, as a whole, along an oblique-to-horizontal path as the chair back is caused to recline (by a user leaning back with emphasis on the upper part of the chair back 20 while seated in the chair, to move the chair from its FIG. 3 to its FIG. 4 position, and for causing the reverse, as the person concentrates their weight downwards on the rear part of the upholstered seat of the upholstered seat and arm frame unit, while reducing backward pressure on the chair back, thereby moving the chair from its FIG. 4 fully reclined position, back to its FIG. 3 intermediate, TV position.

These interpivoted links, on each side linkage, are shown including an L-shaped chair back mounting link 150, having a forwardly projecting lower leg 152 and an upwardly projecting leg 154.

A forwardly and downwardly pointing V-shaped link 156 has an upper leg 158 and a lower leg 160. The rear end of the upper leg 158 is pivotally connected by the transverse, horizontal axis pivot joint 142 to the upper end of the rear support link 134. The rear end of the lower leg 160 is pivotally connected by a transverse, horizontal axis pivot joint 162, to the lower, forward end of a connecting link 164, the upper, rear end of which is connected by a transverse, horizontal axis pivot joint 166 to a site at the lower, rear leg juncture (apex) of the L-shaped link 150.

The chair back, at its left and right sides, bolts to the legs 154 of the L-shaped links 150.

The forward end of the forwardly projecting lower leg 152 of each L-shaped link 150 is connected by a respective transverse, horizontal axis pivot joint 168 to an upwardly, rearwardly projecting tab at the upper rear of the main plate 62, above the upper flange 50 of the member 48 of the bracket 16. In the FIGS. 2 and 3 positions of the mechanism, the pivot joints 168 are approximately aligned with the pivot joints 142, transversely of the chair.

A compression coil spring 170, which elastically stretches as the chair is moved from its FIG. 3 to its FIG. 4 position, and recovers as the chair moves back to its FIG. 3 position, has its opposite ends hooked over laterally outwardly projecting upper and lower pins 172, 174 respectively mounted on the main plate 62 and an intermediate site on the upper 158 leg of the V-shaped link 156.

As the chair back is reclined, the seat and arm frame unit moves forwards about 2.5 inches relative to the base, and the seating plane raises (by about an inch at the front end of the bracket 16, and by about two inches at the rear of the bracket 16), as the V-shaped links 156 pivot about horizontal axis pivot joints 176 by which intermediate sites on their upper legs 158 (below and forwardly of the spring anchor pins 174).

Upon movement from the TV position to the fully reclined position, mechanism movement is stopped by engagement of the lower edges of the lower legs 152 of the L-shaped links with the seating plane flange 50 of the members 48 of the hollow rectangular bracket 16.

Upon movement of the chair from the fully reclined (FIG. 4) position, back to the TV position (FIG. 3), movement is stopped by engagement of medially projecting, transverse, horizontal pins 178 mounted on the main plate 62 with respective sites 181 on the upper edges of the upper legs of the V-shaped links 156.

A guide on each side linkage for the upward, forward movement of the interpivoted links supporting the bracket 16 as the chair recline from the TV position, is provided by a link 180 the upper end of which is pivotally secured by a transverse, horizontal axis pivot joint 182 to the radially outer end of another crank link 184 which is secured to the torque tube 28. The crank link 184 lifts the link 180 as the chair back is reclined, and lowers the link 180 as the chair back is erected. The link 180, in a lower portion thereof has a forwardly and upwardly-downwardly and rearwardly slanting slot 186, which is closed at its upper and lower ends. A pin 188 which is trapped in the slot 186 projects medially from where it is mounted on the inboard side of the v-shaped link 156, near the forwardly located apex of the latter.

In the FIG. 2, fully erect position, the pin 188 is at the upper end of the slot 186; in the FIG. 3, TV position, the pin 188 is at the lower end of the slot 186; and, in the FIG. 4, fully reclined position, the pin 188 is located intermediate the ends of the slot 186.

The trajectory of the bracket 16 upon movement from the TV position to the fully reclined position, and back, is further constrained for each side linkage by a link 190 which projects downwardly and forwardly, having its upper end pivotally connected to the upper end of the front support link 132 by the joint 140, and its lower end pivotally connected to a downwardly projecting tab 192 at the front end of the main plate 62, by a transverse, horizontal axis pivot joint 194.

As an important feature, the chair occupant is additionally supported by strut links 196 which extend forwardly and downwardly from upper end transverse horizontal axis pivot joints 198 to the radially outer ends of the respective crank links 184, to lower end transverse, horizontal axis pivot joints 200 provided on upstanding tabs 202 secured on the flanges 32 of the longitudinal members 30 of the base 12, respectively near the left and right front corners of the base 12. The pivot joints 198 are located forwardly of the torque tube 28 when the chair is in its FIG. 2, fully erect position, and directly above the torque tube 28 when the chair is in its FIG. 3 intermediate, TV, position.

The strut links 196 rotate about their lower ends from a more horizontal to an about 45° inclination as the chair moves from the fully erect position to the TV position, and further to an about 60° inclination as the chair moves from the TV position to the fully reclined position.

The upholstered seat and arm frame unit can be provided with a wide range of styles. In the preferred embodiment, it bolts to a front and rear transverse members 54, 56 of the mounting bracket 16, and to L-shaped laterally outwardly projecting depending flanges 204 which are bolted to cantilevered outerigger stubs of the transverse member 66.

The mechanism for the chair 10 is preferably made of conventional materials, e.g., steel plate, punched, bent, bored and painted flat black; steel pins; self-lubricated plastic washer-like bushings for joints, steel rivet-type pivot joints, attention being given to thickness and strength, given that the chair 10 preferably is made for use by especially tall and heavy users.

However, the support struts and/or seat and arm frame support bracket could be provided on motion chairs intended for use by average-sized persons as well.

The principles of the invention have been shown and explained in relation to a free-standing, single seat chair having two arms. However, the principles of the invention can be applied to motion seating furniture in which the upholstered seat and arm frame is one-armed (as in a recliner unit for an armed end of a multiple seat sectional sofa), or is replaced by an armless upholstered seat frame (as in a recliner unit for an armless end of a multiple seat sectional sofa).

It should now be apparent that the reclining chair and mechanism therefor as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A combined mechanism and base for a reclining chair which includes an upholstered seat frame, an upholstered back, an ottoman, comprising: a base arranged to be supported on a floor; and a mechanism including:

left and right side linkages including:

left and right sets of pantographically interpivoted links for mounting the ottoman for extension to an extended position and retraction to a retracted position;

left and right sets of interpivoted support links for supporting the upholstered seat frame relative to the base for movement between a rear, less tilted forwardly up erect position and a forward, more tilted forwardly up TV position; and left and right sets of interpivoted support links for supporting the upholstered back for movement between a more erect position achievable when the ottoman is in said retracted or extended position, and a more recumbent position which is achievable only when the ottoman is in said extended position;

a plurality of transverse members fixedly interconnecting a plurality of corresponding links of said left and right side linkages;

a transversely extending torque tube journalled in said left and right side linkages for reversible rotation about its own longitudinal axis;

interpivoted crank and driving links operatively connecting said torque tube with said pantographically interpivoted links, for extending the ottoman upon rotation of the torque tube in one angular direction and for retracting the ottoman upon rotation of the torque tube in an opposite angular direction;

at least one strut which extends downwardly and forwardly from a single pivotal connection to the torque tube at a radial offset from said longitudinal axis, to a single pivotal connection to said base; each said strut being arranged to provide support from said base to a user when seated in the chair, when the ottoman is extended and retracted and is being extended and retracted, when the upholstered seat frame is in the erect and TV positions, and is being moved between the erect and TV positions, and the upholstered back is in the more erect and more recumbent positions, and is being moved between the more erect and more recumbent positions.

2. The combined mechanism and base of claim 1, wherein:

there are two said strut links one associated with said left side linkage at a left front corner of said base, and another associated with said right side linkage at a right front corner of said base.

3. The combined mechanism and base of claim 2, wherein:

said left and right sets of interpivoted support links include left and right longitudinal members of a hollow rectangular support bracket for the upholstered seat frame; and said plurality of transverse members include forward and rear members of said hollow rectangular support bracket, rigidly joined at respective corners to said left and right longitudinal members of said hollow rectangular support bracket.

4. The combined mechanism and base of claim 3, wherein:

at least one forwardly located one of said transverse members and at least one rearwardly located one of said transverse members extend both leftwardly and rightwardly laterally outwardly beyond said left and right longitudinal members of said hollow rectangular support bracket to provide cantilevered mounting sites for securement of the upholstered seat frame thereto.

5. A reclining chair, comprising:

an upholstered seat frame;

an upholstered back;

an ottoman;

a base arranged to be supported on a floor;

a mechanism including:

left and right side linkages including:

left and right sets of pantographically interpivoted links mounting the ottoman for extension to an extended position and retraction to a retracted position;

left and right sets of interpivoted support links supporting the upholstered seat frame relative to the base for movement between a rear, less tilted forwardly up erect position and a forward, more tilted forwardly up TV position; and left and right sets of interpivoted support links supporting the upholstered back for movement between a more erect position achievable when the ottoman is in said retracted or extended position, and a more recumbent position which is achievable only when the ottoman is in said extended position;

a plurality of transverse members fixedly interconnecting a plurality of corresponding links of said left and right side linkages;

a transversely extending torque tube journalled in said left and right side linkages for reversible rotation about its own longitudinal axis;

interpivoted crank and driving links operatively connecting said torque tube with said pantographically interpivoted links, for extending the ottoman upon rotation of the torque tube in one angular direction and for retracting the ottoman upon rotation of the torque tube in an opposite angular direction; and at least one strut which extends downwardly and forwardly from a single pivotal connection to the torque tube at a radial offset from said longitudinal axis, to a single pivotal connection to said base; each said strut being arranged to provide support from said base to a user when seated in the chair, when the ottoman is extended and retracted and is being extended and retracted, when the upholstered seat frame is in the erect and TV positions, and is being moved between the erect and TV positions, and the upholstered back is in the more erect and more recumbent positions, and is being moved between the more erect and more recumbent positions.

6. The reclining chair of claim 5, wherein:

there are two said strut links one associated with said left side linkage at a left front corner of said base, and another associated with said right side linkage at a right front corner of said base.

7. The reclining chair of claim 6, wherein:

said left and right sets of interpivoted support links include left and right longitudinal members of a hollow rectangular support bracket supporting the upholstered seat frame; and said plurality of transverse members include forward and rear members of said hollow rectangular support bracket, rigidly joined at respective corners to said left and right longitudinal members of said hollow rectangular support bracket.

8. The reclining chair of claim 7, wherein:

at least one forwardly located one of said transverse members and at least one rearwardly located one of said transverse members extend both leftwardly and rightwardly laterally outwardly beyond said left and right longitudinal members of said hollow rectangular support bracket and provide cantilevered mounting sites at which the upholstered seat frame is secured thereto.

* * * * *